United States Patent [19]

Barbano et al.

[11] 4,152,706

[45] May 1, 1979

[54] LOG PERIODIC ZIG ZAG MONOPOLE ANTENNA

[75] Inventors: Normand Barbano, Sunnyvale; Samuel C. Kuo, Saratoga, both of Calif.

[73] Assignee: The United States of America as represented by the Secretary of the Army, Washington, D.C.

[21] Appl. No.: 864,993

[22] Filed: Dec. 27, 1977

[51] Int. Cl.[2] ..... H01Q 11/10

[52] U.S. Cl. ..... 343/792.5

[58] Field of Search ..... 343/792.5, 803, 806, 343/816

[56] References Cited

U.S. PATENT DOCUMENTS

| | | | |
|---|---|---|---|
| 3,212,094 | 10/1965 | Berry | 343/792.5 |
| 3,268,904 | 8/1966 | Noguchi et al. | 343/804 |
| 3,271,775 | 9/1966 | Yang | 343/792.5 |

*Primary Examiner*—Eli Lieberman

*Attorney, Agent, or Firm*—Nathan Edelberg; Robert P. Gibson; Freddie M. Bush

[57] ABSTRACT

The basic log periodic zig zag antenna is made of one continuous conductor wherein vertical wires function as radiators when they are in resonance. Horizontal wires of the antenna are the phasing stubs, which provide the proper phase shift for the radiating elements. Efficiency of the antenna is enhanced by effectively shortening the path between adjacent elements in the active region with a single conductor. Additionally, a vertical conductor between the shortened path conductor and the respective radiating elements reduces the resonance Q of the vertical radiators and functions as a mechanical support for the radiators.

2 Claims, 4 Drawing Figures

LOG PERIODIC ZIG ZAG MONOPOLE ANTENNA

DEDICATORY CLAUSE

The invention described herein was made in the course of or under a contract or subcontract thereunder with the Government and may be manufactured, used, and licensed by or for the Government for governmental purposes without the payment to use of any royalties thereon.

BACKGROUND OF THE INVENTION

The need for a wide band, vertically-polarized antenna for high frequency communication systems has led to the development of logarithmically periodic antennas. The log periodic bent zig zag antenna is one of the first log periodic structures introduced which provided vertical polarization and frequency independent performance over a ground plane. The maximum height of the log periodic zig zag antenna is a quarter of the lowest operating wavelength, making it ideal for low VHF communication applications.

"The Bent Log Periodic Zig Zag Antenna" by J. W. Greiser, a supplement to Interim Engineering Report No. 4 for Broadband Wide Aperture Radio Location Antenna System, is a technical report of the Antenna Laboratory, University of Illinois, 31 May 1962. This report provides extensive analysis of log periodic antennas with measured pattern and impedance data. The physical parameters of the bent log periodic zig zag antennas are disclosed beginning at page 19 with reference to FIG. 4, page 20. The vertical wires are the radiators when they are in resonance and the horizontal wires are phasing stubs. Typical of these antennas parameters are the vertical length, which is the distance from a point of origin to the tip of the longest element and the angles from the axis passing through the origin to the tips of the radiating elements and phasing stubs. The plane of the horizontal stubs is also inclined at an angle and passes through the origin. Numerous other parameters exist for the basic antenna which are fully disclosed in the prior art, as for example at pages 19–29 of the Greiser report.

SUMMARY OF THE INVENTION

An improved log periodic zig zag antenna includes the basic radiating elements and phasing stub elements formed of one continuous conductor and an additional conductor which functions as a shortened transmission region and is coupled to the base of the radiating elements and the phasing elements, lying in the plane of the horizontal phasing elements and passing through the origin. Additional vertical conductors may be joined between the shortened transmission element and the respective radiating elements to reduce the resonance Q and add mechanical strength.

DESCRIPTION OF THE PREFERRED EMBODIMENT

In prior art log periodic zig zag antennas the excitation currents must travel through the transmission region before they reach the radiation region. Where the continuous conductor of the antenna is a relatively small size, the power loss is considerable, decreasing the efficiency of the antenna. While the power loss can be reduced by increasing conductor size, this is impractical in the low VHF (Very High Frequency) or HF (High Frequency) applications where the antenna has great utility.

Figure 3:
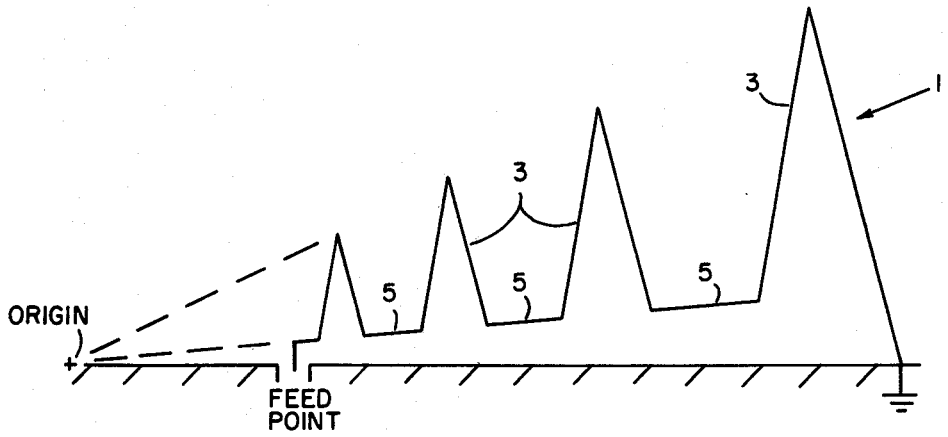
FIG. 3 (PRIOR ART)
FIG. 3 is a typical prior art antenna schematic for established antenna parameters.
Figure 4:
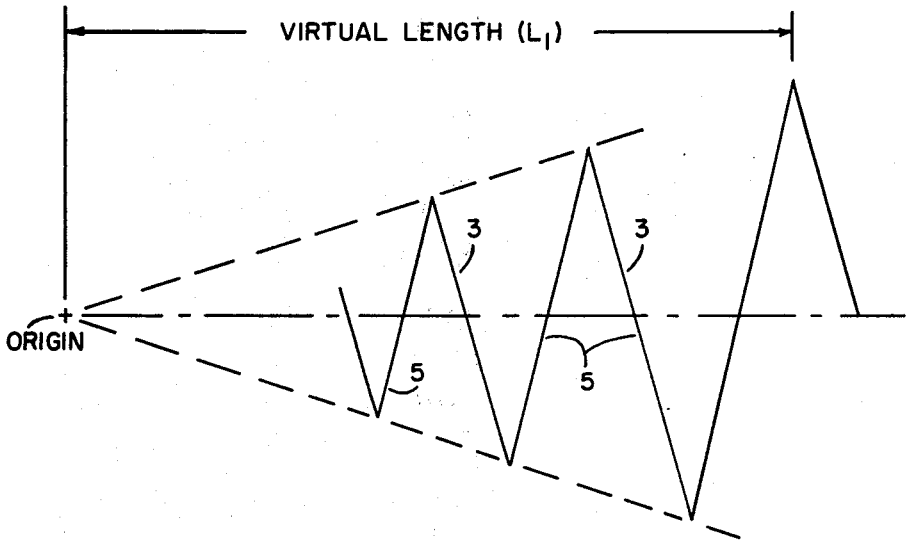
FIG. 4 (PRIOR ART)
FIG. 4 is a typical prior art antenna showing the vertical and horizontal components projected or folded into one plane for identifying parameters.

FIGS. 3 and 4 disclose the typical prior art bent log periodic zig zag antenna. The antenna 1 is made of one continuous conductor with the vertical wires 3 functioning as radiators when they are in resonance. The horizontal wires 5 are the phasing stubs which provide the proper phase shift for the radiating elements in the active region. The transmission region of the antenna is identified as that region of the antenna where the conductor serves as transmission lines. Very little radiation takes place in this region because the vertical elements are very small in terms of the operating wavelength.

The radiation or active region is the portion of the antenna structure where radiation takes place. In this region, the vertical elements are either at or near the quarter-wave resonance. Most of the excitation currents are attenuated in this region due to radiation, with the horizontal elements providing proper phasing between adjacent vertical elements. Immediately beyond the active region is an unused portion of the antenna structure, since most of the excitation currents are attenuated in the active region. This permits the log periodic antenna to be truncated.

Figure 1:
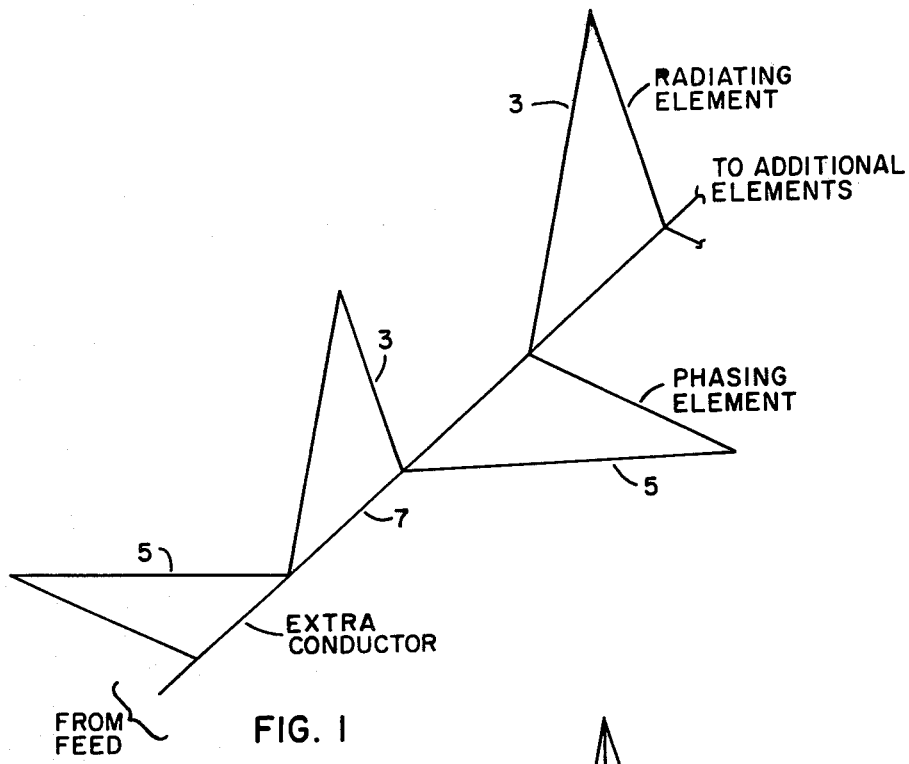
FIG. 1 is a preferred embodiment of the antenna with the transmission conductor coupled along the base of the radiating and phasing elements.

To increase the efficiency of the antenna without increasing conductor size, it is necessary to shorten the path between adjacent elements in the active region. As shown in FIG. 1, this is accomplished by adding an extra conductor 7 to the antenna structure. The basic design of the zig zag antenna may be accomplished through established prior art methods, typically, as noted in the Greiser Report, and as such is not considered to be part of the instant invention. Addition of conductor 7 changes the phasing between the vertical radiating elements such that the pattern shape, side lobe levels, front-to-back ratio, gain, and cross polarization characteristics are all improved over the basic bent log periodic zig zag designs. Since most of the excitation currents take the shorter path through conductor 7, the transmission line loss encountered with the basic antenna is greatly reduced.

Figure 2:
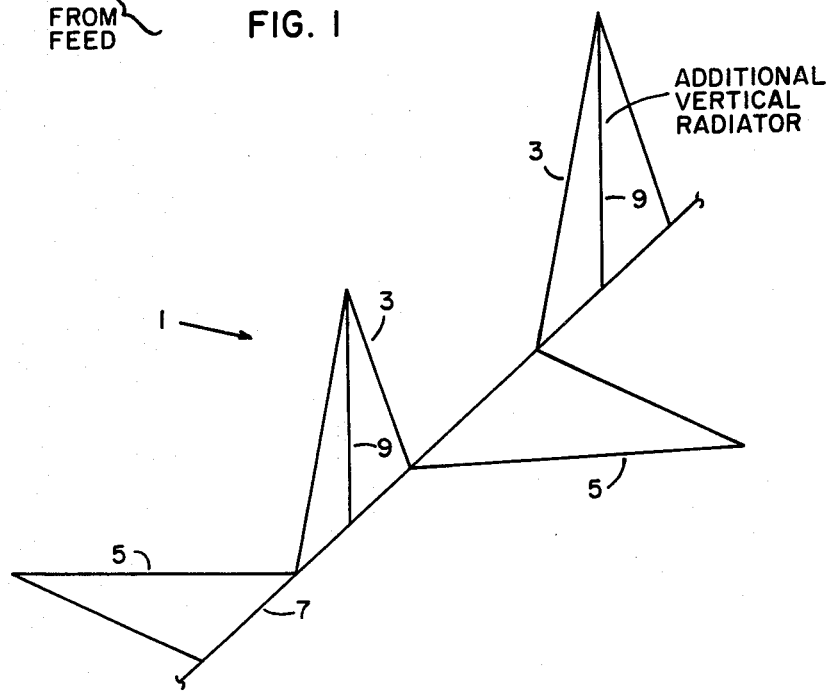
FIG. 2 is an embodiment of the antenna with additional vertical radiators for increasing antenna efficiency.

As shown in FIG. 2, with the presence of additional conductor 7, it is possible to add another vertical conductor 9 to all of the radiating elements 3. The additional vertical conductor 9 provides a vertical, mechanical support, such as a tower, for the radiating elements 3. The presence of this additional vertical conductor also reduces the resonance Q of the vertical radiators. This increases the number of radiating elements that fall within the active region of resonance, thereby providing a greater antenna directivity. This modified version of the log periodic bent zig zag antenna has higher gain than prior art designs.

Although a particular embodiment and form of this invention has been illustrated, it is obvious to those skilled in the art that modifications may be made without departing from the scope and spirit of the foregoing disclosure. Therefore, it is understood that the invention is limited only by the claims appended hereto.

We claim:

1. In a log periodic zig zag antenna having vertical radiating elements and horizontal phasing stub elements wherein the vertical elements and the horizontal elements function as a transmission line for input signals, the improvement comprising: a single transmission conductor joining said vertical and horizontal elements and lying in the plane of said horizontal elements substantially along a line of intersection of the planes of said horizontal elements and said vertical elements, said transmission conductor being adapted to receive ratio-frequency signals for coupling to said elements for changing phasing between the vertical radiating elements to enhance the antenna operating characteristics and provide a short path for antenna excitation currents; and a vertical conductor coupled between each of said vertical radiating elements and said transmission conductor for reducing the resonance Q of the vertical radiators.

2. In a log periodic zig zag antenna as set forth in claim 1, the improvement wherein said vertical conductor coupled between each of said radiating elements is coupled to the apex of said radiating element, increasing the number of radiating elements in the active region for enhancing antenna directivity.

* * * * *